US006293398B1

(12) United States Patent
Grigsby, Jr.

(10) Patent No.: US 6,293,398 B1
(45) Date of Patent: Sep. 25, 2001

(54) TIE-DOWN DEVICE FOR SECURING A DURABLE GOOD TO A PALLET

(75) Inventor: John M. Grigsby, Jr., Woodstock, GA (US)

(73) Assignee: North American Container Corporation, Mableton, GA (US)

( * ) Notice: Subject to any disclaimer, the term of this patent is extended or adjusted under 35 U.S.C. 154(b) by 0 days.

(21) Appl. No.: 09/532,998

(22) Filed: Mar. 22, 2000

(51) Int. Cl.[7] ..... B65D 85/68

(52) U.S. Cl. ..... 206/335; 206/386; 248/500; 229/122.27

(58) Field of Search ..... 206/335, 320, 206/386, 600; 248/500, 503, 680, 651; 108/55.1, 55.3, 55.9; 229/122.27, 199.1; 217/36

(56) References Cited

U.S. PATENT DOCUMENTS

| | | | | |
|---|---|---|---|---|
| 2,249,270 | | 7/1941 | Boeye . | |
| 2,515,428 | | 7/1950 | Scott et al. . | |
| 2,686,028 | | 8/1954 | Johnson . | |
| 3,601,251 | | 8/1971 | Schwaner . | |
| 4,008,847 | | 2/1977 | Davis . | |
| 4,171,741 | | 10/1979 | Fish . | |
| 4,824,137 | * | 4/1989 | Bolden | 108/55.3 |
| 4,832,256 | | 5/1989 | Grigsby . | |
| 4,926,953 | * | 5/1990 | Platt | 248/503 |
| 5,096,112 | | 3/1992 | Grigsby . | |
| 5,154,258 | * | 10/1992 | Krukow | 248/509 |
| 5,398,832 | | 3/1995 | Clive-Smith . | |
| 5,622,306 | | 4/1997 | Grigsby, Sr. . | |

OTHER PUBLICATIONS

North American Container Corp. "Wood–Cleated Corrugated".

* cited by examiner

*Primary Examiner*—Shian Luong
(74) *Attorney, Agent, or Firm*—Baker, Donelson, Bearman & Caldwell

(57) ABSTRACT

An elongate member with a first hook at one end and a relatively sliding hook received on the elongate member are disposed in opposing relation for securing a durable good such as a riding lawn mower to a pallet. The sliding hook attaches to a sleeve in order to move relative to the first hook. A nut engages a threaded portion of an opposing end of the elongate member to bear against the sliding hook to secure it in position. The first hook engages a portion of the pallet, and the sliding hook engage a portion of the durable good received on the pallet. The nut restrains the sliding hook from moving away from the first hook, and thereby securing the durable good to the pallet. A wood-cleated corrugated paperboard body is received on the pallet to enclose the durable good. A method of securing a durable good such as a riding lawn mower to a pallet is disclosed.

17 Claims, 2 Drawing Sheets

TIE-DOWN DEVICE FOR SECURING A DURABLE GOOD TO A PALLET

The present invention relates to containers for enclosing heavy durable goods. More particularly, the present invention relates to tie-down devices for securing heavy durable goods to pallets in containers.

BACKGROUND OF THE INVENTION

Heavy durable goods such as garden tractors, riding lawn mowers, refrigerators, and other such products have long been packaged in a variety of types of containers for storage and shipping. Often these containers include a pallet that supports the goods in the container. The containers are then enclosed, such as by cleated crates or corrugated paperboard bodies. U.S. Pat. No. 4,832,256 describes a container having a pallet that receives a corrugated paperboard body to enclose the durable good on the pallet. Containers of this type are particularly useful for packaging riding lawn mowers. The lawn mower sits on a wood pallet that receives a wood-cleated corrugated paperboard body and a wood top frame. The container is closed with flaps, and the body is secured to the pallet with staples. Prior to positioning the corrugated paperboard body, the tractor is secured to the pallet. Securing the tractor permits the container to be handled, for example, by forklifts, platten trucks, and hand-operated lifts, as well as moved in trucks from manufacturers to retail distribution centers.

Various mechanisms have been provided for securing the heavy durable goods to the pallet. For example, some refrigerators have support members in the bottom of the refrigerator. The support members have threaded bores which typically receive castors or rollers for ordinary use. For shipping purposes, however, the bores receive threaded bolts which pass through the pallet into the base of the refrigerator for securing the refrigerator to the pallet. Installing bolts from below a pallet into the refrigerator is difficult and special handling is required.

For riding lawn mowers, elongate flexible straps are often used to secure the lawn mower to the pallet. Wheel wells defined in the pallet receive the wheels of the garden tractor to help prevent it from rolling.

While such mechanisms are gainfully used for securing the heavy durable good to the pallet, there are drawbacks to their use. Straps, which are typically used, are cumbersome to install and remove. The straps can be cut, but for metal banding, cutting leaves sharp-edged ends. Also the straps tend to spring away forcibly when cut, which can cause injury.

Accordingly, there is a need in the art for an improved device to hold durable goods to pallets in containers for shipping, storage, and handling. It is to such that the present invention is directed.

SUMMARY OF THE PRESENT INVENTION

The present invention meets the need in the art by providing an improved tie-down device for securing a durable good to a pallet. The tie-down device comprises an elongate member that defines an engager at a first end. A second engager opposing the first engager is operatively connected to the elongate member for relative movement with respect to the first engager. A stop is operatively disposed at a portion of an opposing second end of the elongate member, whereby the first engager, being engaged to a portion of a pallet, and the second engager, being engaged to a portion of a durable good received on the pallet, cooperatively secure the durable good thereto by disposing the stop in engagement with the second engager to prevent the second engager from moving away from the first engager.

In another aspect, the present invention provides method of securing a durable good to a pallet with a tie-down device, comprising the steps of (a) placing a durable good on a pallet; (b) attaching a first engager at a distal end of an elongate member to the pallet; (c) operatively connecting a second engager to the elongate member; (d) attaching the second engager to the durable good; (e) securing the second engager to the elongate member with a stop, whereby the stop restricts the first engager and the second engager from moving relatively apart to thereby secure the durable good to the pallet.

Objects, features, and advantages of the present invention will become apparent from a reading of the following specifications, in conjunction with the drawings and the appended claims.

DETAILED DESCRIPTION OF THE PREFERRED EMBODIMENT

Figure 1:
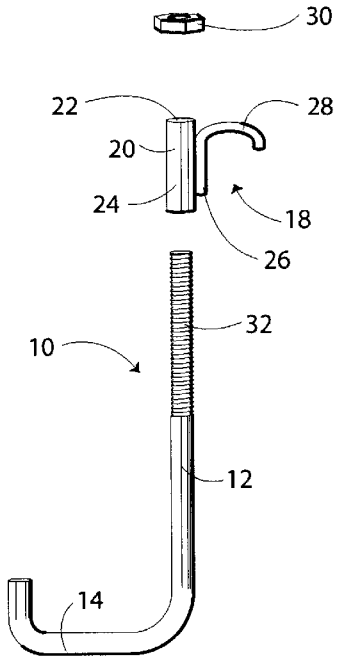
FIG. 1 is a perspective exploded view of a tie-down device according to the present invention.

Referring now in more detail to the drawings, in which like numerals indicate like parts throughout the several views, FIG. 1 illustrates a perspective exploded view of a tie-down device 10 according to the present invention, useful for securing heavy durable goods to a pallet for storage and shipping. The tie-down device 10 comprises an elongate member 12 that defines a first hook 14 at a first distal end. A second hook 18 is received on the elongate member 12 in opposing relation to the first hook 14. The second hook 18 includes a sleeve 20 having open opposing ends 22, 24. An arm 26 attaches to the sleeve 20 and extends laterally to define an engaging portion 28. The elongate member 12 and the arm 26 are metal rods or other suitable high strength material. The sleeve 20 is a cylinder of a metal or other suitable material. In the illustrated embodiment, the arm 26 is welded to the sleeve 20. The arm 26 in the illustrated embodiment defines a hook extending laterally of the sleeve 20. The hook is oriented in opposing relation to the hook 14 at the opposing end of the elongate member 12. The enlongate member 12 also includes a stop, for a purpose discussed below. In the illustrated embodiment, the stop comprises a nut 30, and the elongate member 12 defines a threaded portion 32 opposed to the first hook 14.

Figure 2:
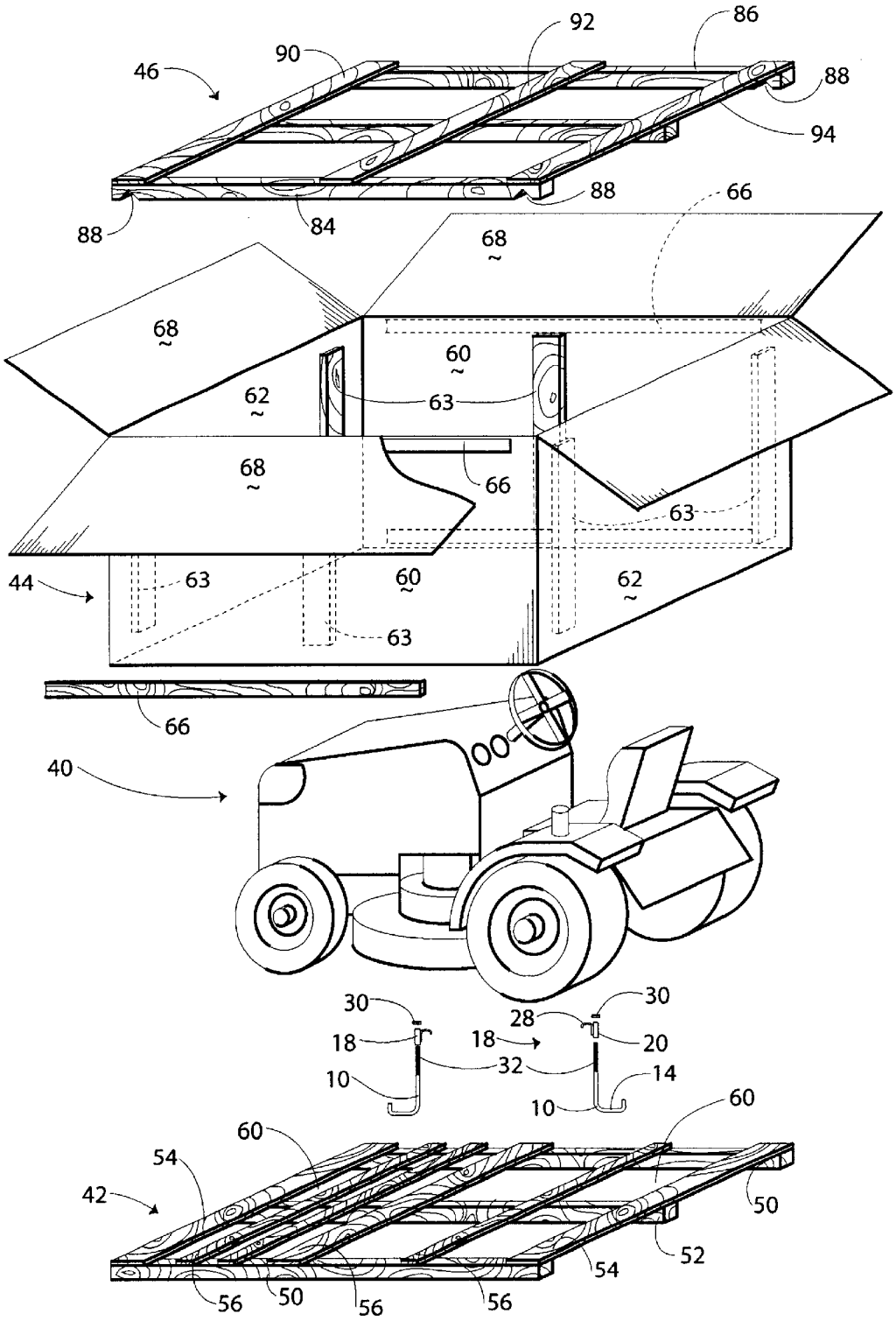
FIG. 2 is a perspective exploded view of a wood-cleated corrugated paperboard container with the tie-down device illustrated in FIG. 1.

FIG. 2 is a perspective exploded view of a wood-cleated corrugated paperboard container 40 for packaging durable goods, such as lawn and garden tractors, for shipping and storage. The container 40 includes a pallet 42 that receives a wood cleated corrugated paperboard body 44, and is closed by a top frame 46. The pallet 42 includes a pair of outside runners 50 and a middle runner 52. The runners 50 and 52 are connected together by end cross members 54 and cross members 56. The adjacent cross members 56 and the respective end cross members 56 cooperatively define wheel wells generally designated 60 for receiving the lower arcuate sections of the wheels of a lawn and garden tractor held on the pallet 42.

The corrugated paperboard body 44 defines a pair of opposing side walls 60 and a pair of opposing end walls 62. A plurality of cleats 63 are attached to the interior surface of the body 44. The cleats 63 are preferably hardwood boards, but may be manufactured structural members according to the teachings of U.S. Pat. No. 5,520,982. The cleats 63 seat on the pallet 42 and receive the top frame 46, as discussed below. The upper ends of the cleats 63 on the end panels 62 preferably define beveled ends tapering from an outside edge downwardly to the side panel 60. Elongate attaching strips 66 are attached to the outer surfaces of the opposing side wall 60 in upper and lower portions, for receiving staples when the corrugated paperboard body 44 is secured to the pallet 42, as discussed below. The attaching strips 66 are preferably made of a dense material, and each extends substantially the length of their respective side panel 60. In an alternate embodiment, several lengths of an elongate dense material are positioned spaced-apart and in linear alignment on the panel 60 as the attaching strip. The attaching strips maybe formed of fiber board, wood, paperboard, or a like material suitable for rigidly holding staples or other fasteners. The attaching strips 66 are preferably bonded to the panels 60 with adhesive during manufacture. Top flaps 68 are foldingly attached at upper edges of the sides 60 and ends 62.

Figure 3:
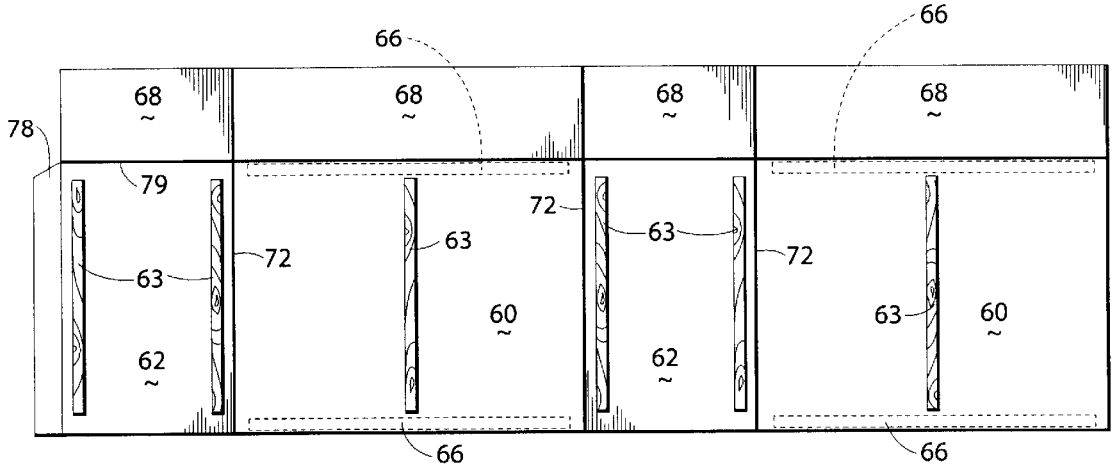
FIG. 3 is a top plan view of a corrugated paperboard blank for forming a container body for being received by the pallet illustrated in FIG. 2.

FIG. 3 illustrates in plan view a corrugated paperboard blank 70 having a plurality of scores 72 that define the end panels 62 and the side panels 60. The cleats 63 attach to the blank 70 adjacent the scores. A manufacturers joint 78 is defined at one end of the blank by a score. The flaps 68 are defined by a score 79 extending lengthwise of the blank 70. The corrugated paperboard body 44 is formed by attaching the manufacturers joint to the side panel 60 at the opposing end of the blank 70.

The top frame 46 consists of two members 84 and 86 that run lengthwise of the box. The lengthwise members 84, 86 are formed with notches 88 at the respective distal ends. The notches 88 matingly receive beveled upper edges of the cleats 63 on the end panels 62. Three spaced-apart members 90, 92 and 94 are secured to the upper surfaces of the two lengthwise pieces 84, 86. These members are secured by nails, staples, or other suitable connectors. The top frame 46 is dimensioned to sit in the uppermost portion of the corrugated paperboard body 44.

With reference to FIGS. 1 and 2, the tie-down device 10 is used for securing heavy durable goods, such as riding lawn mowers, tractors, refrigerators, washers, and other such goods, to pallets in containers. The tie-down device 10 is assembled by connecting the second hook 18 to the elongate member 12. This is accomplished by sliding the sleeve 20 onto the threaded portion 32. The nut 30 is threaded onto the elongate member 12.

In the packaging portion of a manufacturing line, the pallet 42 is removed from a stack and positioned for receiving the durable good to be packaged, such as the illustrated riding lawn mower. The lawn mower is placed on the pallet 42. The elongate member 12 is positioned with the hook 14 below one of the transverse cross members 56 for engagement of the tie-down device 10 to the pallet 42. The second hook 18 moves longitudinally relative to the first hook 14. The hooks 14 and 18 are disposed in opposing relation. The arm 26 of the second hook 18 is engaged to a portion of the riding lawn mower. The nut 30 is then moved along the threaded portion 32 of the elongate member. The nut 30 bears against a upper portion of the sleeve 20. This prevents the second hook 18 from moving away longitudinally relative to the first hook 14. The tie-down device 10 thereby secures the riding lawn mower to the pallet. More than one tie-down device 10 may be used to securely hold the goods to the pallet; FIG. 2 illustrates two tie-down devices 10 disposed on opposing sides of the tractor.

The top frame 46 is received on the upper end of the wood-cleated corrugated paperboard body 44. The members 84, 86 seat on the upper ends of the cleats 63. The beveled surfaces 88 engage the beveled ends of the cleats 63 on the ends 62, to help lock the top frame 46 to the body 44. The flaps 68 are folded to close the container 40. Staples are driven through the attaching strips 66, the panels 60, and into the wood members of the pallet 42 and the top frame 46 for securing the paperboard body 44 to the pallet and the top frame.

To remove the riding lawn mower, the container 40 is opened. The corrugated paperboard body 44 may be cut adjacent the attaching strips 66 around a bottom portion of the container 40. In an alternate embodiment (not illustrated), conventional tear tapes are attached to interior surfaces of the corrugated paperboard body 44. A flap is provided for accessing the tear tapes. The tear tapes are pulled in order to separate the corrugated paperboard body 44 into an upper and lower portion for opening the container. The nut 30 is then unthreaded from the elongate member 12. This frees the first and the second hooks 14, 18 for relative movement and respective disengagement from the pallet 42 and the riding lawn mower. In an alternate embodiment, bolt cutters are used to sever the elongate member 12 intermediate the first hook 14 and the second hook 18, and thereby releasing the riding lawn mower from being secured to the pallet 42.

Thus, there is been described a tie-down device to secure heavy durable goods to pallets for enclosing in containers for storage and shipment. While the disclosed tie-down device 10 has been illustrated and used together with a wood-cleated corrugated paperboard body defining the enclosing container 40, it is to be appreciated that the tie-down device is gainfully employed in cleated crates, open pallets, and corrugated paperboard containers, and other such containers for securing heavy durable goods to pallets. The principles, preferred embodiments, and modes of operation of the present invention have been described in the forgoing specifications. The invention is not to be construed as limited to the particular forms disclosed because these are regarded as illustrative rather than restrictive. Moreover, variations and changes maybe made by those skilled in the art without departing from the spirit of the invention as described by the following claims.

What is claimed is:

1. A tie-down device for securing a durable good to a pallet, comprising:

an elongate member defining an engager at a first end;

a second engager opposing the first engager and operatively connected to the elongate member for relative movement with respect to the first engager; and a stop operatively disposed at a portion of an opposing second end of the elongate member, whereby the first engager, being engaged to a portion of a pallet, and the second engager, being, engaged to a portion of a durable good received on the pallet, cooperatively secure the durable good thereto by disposing the stop in engagement with the second engager to prevent the second engager from moving away from the first engager.

2. The tie-down device as recited in claim 1, wherein the first engager comprise a hook defined at the first end of the elongate member.

3. The tie-down device as recited in claim 2, wherein the second engager comprises a hook slidingly received on the elongate member.

4. The tie-down device as recited in claim 3, wherein:

the stop comprises a nut; and the elongate member further defines a threaded portion at the second distal end for receiving the nut.

5. The tie-down device as recited in claim 4, wherein the second hook comprises:

an open-ended sleeve; and a member extending laterally from the sleeve, whereby the second hook is slidingly movable on the elongate member.

6. A wood-cleated corrugated paperboard container for enclosing a durable good on a pallet, comprising:

a wood-cleated corrugated paperboard body for being received by the pallet; and a tie-down device as recited in claim 1.

7. A tie-down device for securing a durable good to a pallet, comprising:

an elongate member defining a first hook at a first distal end;

a second hook opposing the first hook and received on the elongate member for longitudinal movement therewith; and a stop operatively disposed at a portion of an opposing second distal end of the elongate member, whereby the first hook, being engaged to a portion of a pallet, and the second hook, being engaged to a portion of a durable good received on the pallet, secure the durable good thereto by the stop being disposed in engagement with the second hook.

8. The tie-down device as recited in claim 7, wherein:

the stop comprises a nut; and the elongate member further defining a threaded portion at the second distal end for receiving the nut.

9. The tie-down device as recited in claim 8, wherein the second hook comprises:

an open-ended sleeve; and a member extending laterally from the sleeve, whereby the second hook is slidingly movable on the elongate member.

10. A wood-cleated corrugated paperboard container for enclosing a durable good on a pallet, comprising:

a wood-cleated corrugated paperboard body for being received by the pallet; and a tie-down device as recited in claim 7.

11. A method of securing a durable good to a pallet with a tie-down device, comprising the steps of:

(a) placing a durable good on a pallet;

(b) attaching a first engager at a distal end of an elongate member to the pallet;

(c) operatively connecting a second engager to the elongate member;

(d) attaching the second engager to the durable good;

(e) securing the second engager to the elongate member with a stop, whereby the stop restricts the first engager and the second engager from moving relatively apart to thereby secure the durable good to the pallet.

12. The method as recited in claim 11, wherein the engager in step (b) comprises a first hook at the distal end of the elongate member, which first hook engages an engaging portion of the pallet.

13. The method as recited in claim 12, wherein the second engager in step (c) comprises a second hook received on the elongate member for movement relative to the first hook at the distal end.

14. The method as recited in claim 13, wherein the step (e) comprises threading a nut on a threaded opposing distal end of the elongate member to bear against the second hook.

15. The method as recited in claim 14, wherein the step (c) comprises sliding an open-ended sleeve on the elongate member, which sleeve includes a member extending laterally therefrom to define the second engager.

16. The method as recited in claim 11, further comprising the step (f) enclosing the durable good on the pallet with a packaging body.

17. The method as recited in claim 11, further comprising the step (f) enclosing the durable good on the pallet with a wood-cleated corrugated paperboard body.

* * * * *